United States Patent [19]

Okutsu et al.

[11] Patent Number: 4,833,064

[45] Date of Patent: May 23, 1989

[54] PROCESS FOR THE FORMATION OF A HIGH CONTRAST NEGATIVE IMAGE

[75] Inventors: Eiichi Okutsu; Morio Yagihara; Mitsunori Hirano; Katsumi Hayashi, all of Kanagawa, Japan

[73] Assignee: Fuji Photo Film Co., Ltd., Kanagawa, Japan

[21] Appl. No.: 25,757

[22] Filed: Mar. 13, 1987

[30] Foreign Application Priority Data

Mar. 14, 1986 [JP] Japan ..... 61-56629

[51] Int. Cl.[4] ..... G03C 1/06; G03C 5/24

[52] U.S. Cl. ..... 430/267; 430/438; 430/439; 430/437; 430/445

[58] Field of Search ..... 430/437, 438, 439, 267, 430/445

[56] References Cited

U.S. PATENT DOCUMENTS

| | | | |
|---|---|---|---|
| 4,328,302 | 5/1982 | Nishimura et al. | 430/264 |
| 4,444,875 | 4/1984 | Nagashima et al. | 430/264 |
| 4,452,882 | 6/1984 | Akimura et al. | 430/267 |
| 4,668,605 | 5/1987 | Okutsu et al. | 430/267 |
| 4,681,836 | 7/1987 | Inoue et al. | 430/267 |

*Primary Examiner*—Paul R. Michl
*Assistant Examiner*—Patrick A. Doody
*Attorney, Agent, or Firm*—Sughrue, Mion, Zinn, Macpeak, and Seas

[57] ABSTRACT

A novel process for the formation of a high contrast negative image is provided which comprises processing a silver halide photographic material with a developing solution, wherein said developing solution contains a dihydroxybenzene developing agent, a 1-phenyl-3-pyrazolidone auxiliary developing agent and/or p-aminophenol auxiliary developing agent, 0.3 mol/liter or more of sulfite, and a compound represented by formula (I)

(I)

wherein Y and Z, which may be the same or different, each represents N or $CR^2$ wherein $R^2$ represents a substituted or unsubstituted alkyl or aryl group; $R^1$ represents an alkyl, aryl or heterocyclic group which is substituted by at least one group selected from the group consisting of $—SO_3M$, —COOM, —OH, $—NHSO_2R^3$, $—SO_2NR^3R^4$ and $—NR^5CONR^3R^4$ or a group formed by alkyl groups, aryl groups or heterocyclic groups via linkage groups; $R^3$, $R^4$ and $R^5$, which may be the same or different, each represents a hydrogen atom or a lower alkyl group containing from 1 to 4 carbon atoms; and M represents a hydrogen atom, an alkali metal atom, quaternary ammonium, or quaternary phosphonium.

15 Claims, No Drawings

PROCESS FOR THE FORMATION OF A HIGH CONTRAST NEGATIVE IMAGE

FIELD OF THE INVENTION

The present invention relates to a process for developing a silver halide photographic material having high contrast. More particularly, the present invention relates to a process for the formation of a high contrast negative image suitable for the photomechanical process in the graphic arts.

BACKGROUND OF THE INVENTION

In the field of graphic arts, a image formation system providing a high contrast photographic property is required to provide excellent reproduction of an image of continuous gradation or a linear image by dot image process.

To this end, a special developing solution referred to as a lith developer has heretofore been used. A lith developer contains only hydroquinone as a developing agent. In order to avoid inhibiting infectious development thereof, the developer contains a sulfite as a preservative in the form of an addition product with formaldehyde so that the concentration of free sulfite ions is extremely low. This renders the developer extremely subject to oxidation by air. Thus, a conventional lith developer has a big disadvantage that it can not be stored for more than 3 days.

The process for obtaining a high contrast photographic property by using a stable developing solution is accomplished by a process which comprises using a hydrazine derivative as described in U.S. Pat. Nos. 4,224,401, 4,168,977, 4,166,742, 4,311,781, 4,272,606, 4,211,857 and 4,243,739. This process can provide a high contrast and a high sensitivity. In this process, a high concentration of sulfite can be added to the developing solution. Therefore, the developing solution is much more table to air oxidation than the conventional lith developer.

However, this process using a hydrazine derivative is disadvantageous in that since the pH value of the developer is higher than that of the common lith developer, a silver halide photographic material is more subject to uneven development when processed by means of an automatic developing machine which is commonly used in the art.

The mechanism of generation of uneven development is unknown. If the pH value of a developing solution is lower than that of the common lith developer, it causes no unevenness in development. However, a light-sensitive material containing a hydrazine derivative is not rendered high contrast. Even if a high pH developer providing a high contrast is used, there occurs no uneven development when the developer is free of auxiliary developing agent and contains only hydroquinone. However, such a developer containing only hydroquinone is disadvantageous in that when a silver halide photographic material is continuously processed by means of an automatic developing machine, the concentration of halogen ions in the developer (mainly bromide ions) is increased, causing a reduction in photographic sensitivity. Thus, it has been desired to use a compound which provides a high contrast when a developer containing a high pH auxiliary developing agent is used and also causes no unevenness in development without changing sensitivity while maintaining stable photographic properties even when a silver halide photographic material is continuously processed by means of an automatic developing machine.

SUMMARY OF THE INVENTION

It is therefore an object of the present invention to provide a photographic film image having little unevenness of development in a high contrast image formation process using a high pH developing solution.

The above and other objects of the present invention will become more apparent from the following detailed description and examples.

These objects of the present invention are accomplished by processing a silver halide photographic material with a high pH developing solution containing a dihydroxybenzene developing agent, a 1-phenyl-3-pyrazolidone auxiliary developing agent and/or p-aminophenol auxiliary developing agent, 0.3 mol/liter or more of a sulfite, and at least one compound represented by formula (I)

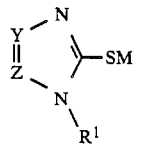

(I)

wherein Y and Z, which may be the same or different, each represents N or $CR^2$ wherein $R^2$ represents a substituted or unsubstituted alkyl or aryl group; R represents an alkyl, aryl or heterocyclic group which is substituted by at last one group selected from the group consisting of $—SO_3M$, —COOM, —OH, $—NHSO_2R^3$, $—SO_2NR^3R^4$ and $—NR^5CONR^3R^4$ or a group formed by alkyl groups, aryl groups or heterocyclic groups via linkage groups; $R^3$, $R^4$ and $R^5$, which may be the same or different, each represents a hydrogen atom or a lower alkyl group containing from 1 to 4 carbon atoms; and M represents a hydrogen atom, an alkali metal atom, quaternary ammonium, or quaternary phosphonium.

DETAILED DESCRIPTION OF TEE INVENTION

Specific examples of the alkyl group represented by $R^1$ include a straight chain or branched alkyl group containing from 1 to 20 carbon atoms such as a methyl group, a propyl group, a hexyl group, a dodecyl group and an isopropyl group, and a cycloalkyl group containing from 1 to 20 carbon atoms such as a cyclopropyl group and a cyclohexyl group. Specific examples of the aryl group represented by $R^1$ include an aryl group containing from 6 to 20 carbon atoms such as a phenyl group and a naphthyl group. Specific examples of the heterocyclic group represented by $R^1$ include 5-membered, 6-membered or 7-membered heterocyclic groups containing one or more nitrogen, oxygen or sulfur atoms and heterocyclic groups which form condensed groups in proper positions such as a pyridine ring, a quinoline ring, a pyrimidine ring and an isoquinoline ring. These alkyl groups, aryl groups and heterocyclic groups may be further substituted. Specific examples of such substituents include halogen atoms such as F, Cl and Br, alkyl groups such as a methyl group and an ethyl group, aryl groups such as a phenyl group and a p-chlorophenyl group, alkoxy groups such as a methoxy group and a methoxyethoxy group, aryloyy groups such as a phenoxy group, sulfonyl groups such as a methanesulfonyl group and a p-toluene sulfonyl group, carbamoyl groups such as a unsubstituted carbamoyl group and a diethylcarbamoyl group, amide groups such as an acetamide group and a eenzamide group, alkoxycarbonylamino groups such as a methoxycarbonylamino group, carbonylamino group, alkoxycarbonyl groups such as a methoxycarbonyl group, aryloxycarbonyl groups such as a phenoxycarbonyl group, a cyano group, a nitro group, amino groups such as an unsubstituted amino group and a dimethylamino group, alkylsulfinyl groups such as a methoxysulfinyl group, arylsulfinyl groups such as a phenylsulfinyl group, alkylthio groups such as a methylthio group, and arylthio groups such as a phenylthio group. The above-mentioned alkyl, aryl, or heterocyclic groups may be substituted by two or more of the same or different substituents.

As substituents for the alkyl group or aryl group represented by $R^2$, there may be used those for the groups represented by $R^1$.

Preferred examples of the above-mentioned linkage group which may be contained in $R^1$ include $$-S-,\ -O-,\ -\overset{R^3}{\overset{|}{N}}-,\ -CO-,\ -SO-,\ -SO_2-,\ -SO_2\overset{R^3}{\overset{|}{N}}-,\ -CO\overset{R^3}{\overset{|}{N}}-,\ \text{and}\ -COO-$$

wherein $R^3$ has the same meaning as defined in the above-mentioned $-NHSO_2R^3$.

Specific examples of $R^1$ containing linkage groups include

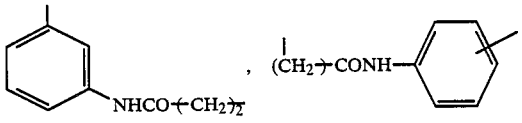

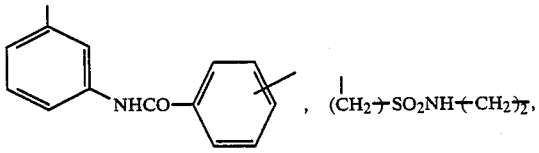

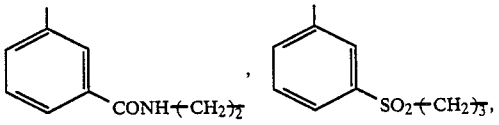

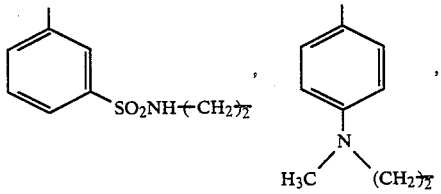

-continued

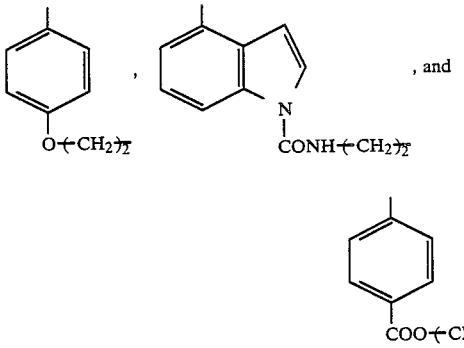

Particularly preferred among the compounds represented by formula (I) is that represented by formula (II)

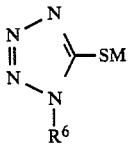

(II)

wherein $R^6$ represents a phenyl group which is substituted by at least one —COOM, $-SO_3M$, —OH, $-NHSO_2R^3$, $-SO_2NR^3R^4$ or $-NR^5CONR^3R^4$ wherein $R^3$, $R^4$ and $R^5$ have the same meaning as defined in the above-mentioned formula (I), and may be further substituted by other substituents.

Such other substituents for the above-mentioned phenyl group have the same meaning as defined in the alkyl groups, aryl groups and heterocyclic groups represented by $R^1$ in formula (I).

If there are two or more —COOM, $-SO_3M$, —OH, $-NHSO_2R^3$, $-SO_2NR^3R^4$, and $-NR^5CONR^3R^4$ substituting groups contained in the same group, they may be the same or different. Particularly preferred among these substituents are —COOM and $-SO_3M$.

M is as defined in formula (I).

Specific examples of compounds represented by formula (I) which can be used in the present invention are shown below, but the present invention is not to be construed as being limited thereto.

(1)

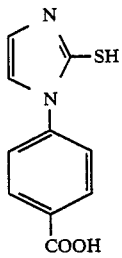

(2)

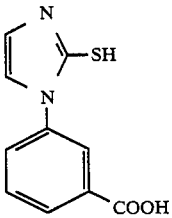

-continued
(3)
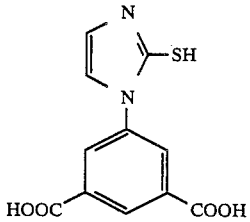
(4)
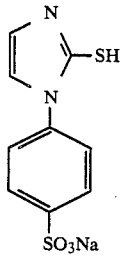
(5)
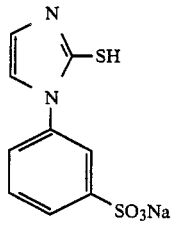
(6)
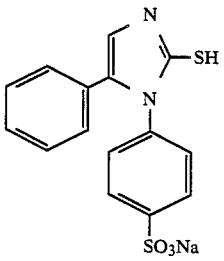
(7)
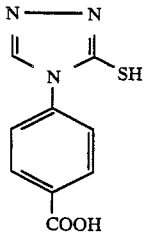
(8)
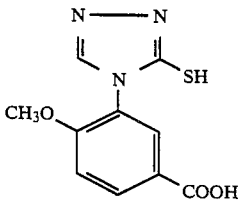
-continued
(9)
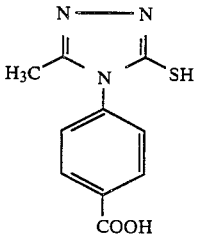
(10)
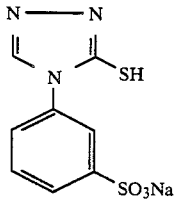
(11)
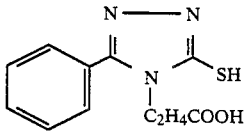
(12)
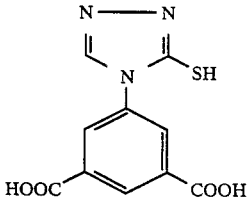
(13)
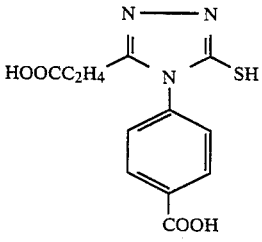
(14)
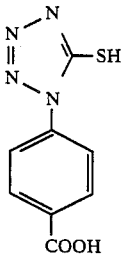
(15)
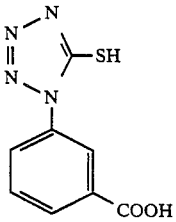

-continued
(16)
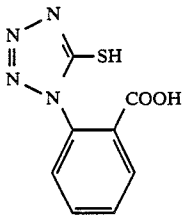
(17)
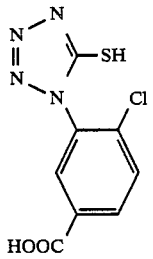
(18)
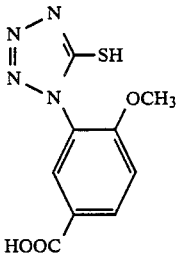
(19)
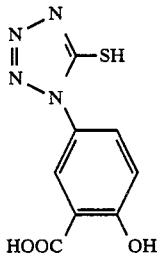
(20)
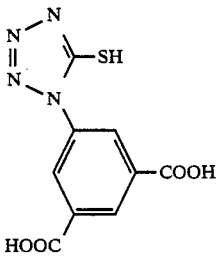
(21)
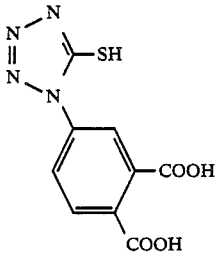
-continued
(22)
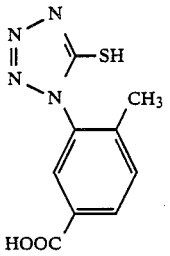
(23)
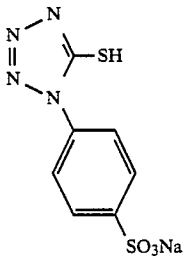
(24)
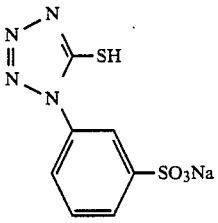
(25)
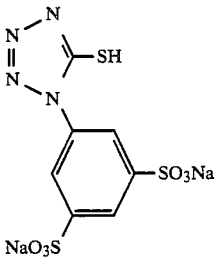
(26)
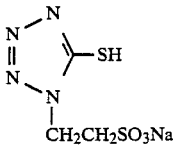
(27)
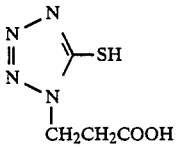
(28)
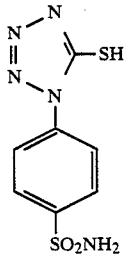

-continued (29)

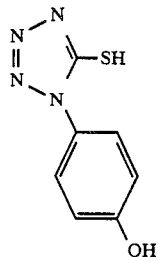

(30)

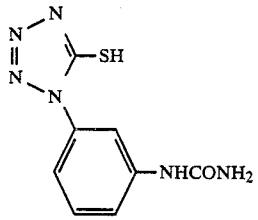

(31)

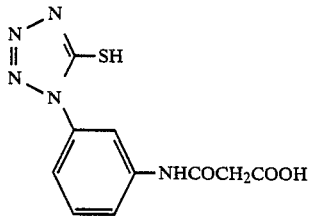

(32)

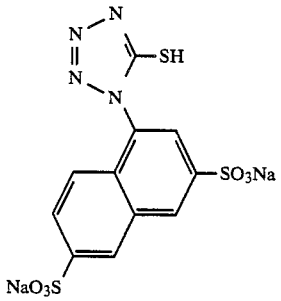

(33)

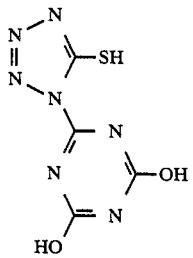

(34)

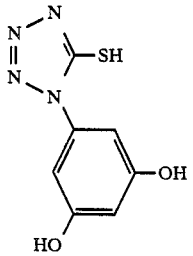

-continued (35)

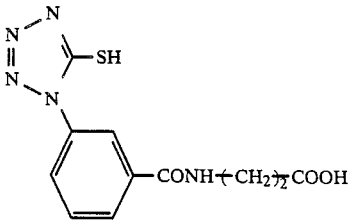

(36)

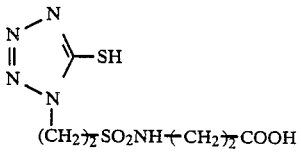

(37)

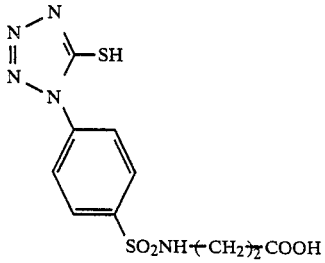

(38)

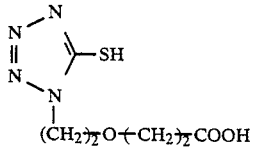

(39)

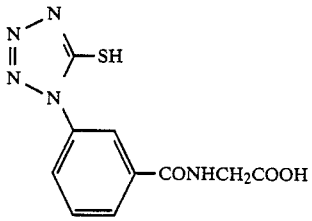

(40)

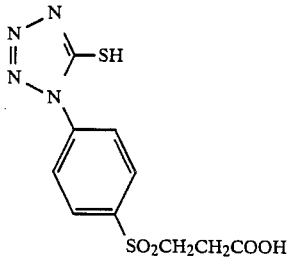

As is generally know, the synthesis of the compound of formula (I) can be easily accomplished by a process using isothiocyanate as a starting material.

Synthesis processes which can be suggestive for the present invention are described in U.S Pat. Nos. 2,585,388, 2,511,924, 3,266,897, British Patent No. 1,275,701, Japanese Patent Publication No. 21842/67, Japanese Patent Application (OPI) No. 111846/81 (the term "OPI" as used herein refers to a "published unexamined Japanese patent application"), D. A. Berges et al., *Journal of Heterocyclic Chemistry* (Vol. 15, No. 981, 1978); *The Chemistry of Heterocyclic Chemistry* (Imidazole and Derivatives, Part I, pp. 336–339); *Chemical*

*Abstract* (Vol. 58, No. 7921, p. 394, 1963); E. Hoggarth, *Journal of Chemical Society* (pp. 1160–1167, 1949); S. R. Sandler and W. Karo, *Organic Functional Group Preparation,* published by Academic Press (pp. 312–315, 1968); I. I. Kovtunovskaya Lovshine, *Tr. Ukr. Inst. Eksperim Endokrinol* (Vol. 18, p. 345, 1961); M. Chamdon et al., *Bull. Chem. Fr.* (p. 723, 1954); D. A. Shirley, D. W. Alley, *J. Amer. Chem. Soc.* (Vol. 79, 4922, 1957); and A. Wohl and W. Marckwald, *Doitsu Kagaku Kaishi* ((Ber.), Vol. 22, p. 568, 1889).

The preferred content of the compound of formula (I) in the developing solution is 5 mg/liter to 1 g/liter, more preferably 10 mg/liter to 500 mg/liter.

The term "high contrast" as used herein means having a gradation (γ) of 4 or more, preferably 6 or more, more preferably 10 or more.

Such a high contrast negative image can be obtained by any suitable known method. Examples of such methods include a method comprising rendering the particle size distribution of a silver halide emulsion monodisperse (Method 1), a method comprising using silver chloride or silver chlorobromide as a halogen composition for the silver halide emulsion (Method 2), a method comprising developing in the presence of a hydrazine compound or a tetrazolium salt compound (Method 3), and a method comprising using a silver halide emulsion containing a compound of the group VIII metal such as rhodium salt (Method 4).

In Method 1, the degree of monodispersion is preferably as described hereinafter.

In Method 2, the content of silver chloride is preferably in the range of 50 to 100 mol %.

In Method 3, the use of a hydrazine compound is described in detail in the U.S. patents mentioned below.

As such a hydrazine compound for this method, a known hydrazine compound may be used. Specific examples of such a known hydrazine compound include hydrazine derivatives described in U.S. Pat. Nos. 4,224,401, 4,168,977, 4,166,742, 4,311,781, 4,272,606, 4,211,857 and 4,243,739. The method comprising using tetrazolium is described in detail in Japanese Patent Application (OPI) Nos. 18317/77, 17719/78 and 17720/78.

As a hydrazine derivative which may be used in the present invention, there is preferably used a compound represented by formula (III)

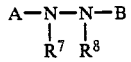

$$A-\underset{\underset{R^7}{|}}{N}-\underset{\underset{R^8}{|}}{N}-B \qquad \text{(III)}$$

wherein A represents an aliphatic or aromatic group; B represents a formyl group, an acyl group, an alkyl or arylsulfonyl group, a carbamoyl group, an alkoxy or aryloxycarbonyl group, a sulfamoyl group, an alkoxysulfonyl group, a thioacyl group, a thiocarbamoyl group, or a heterocyclic group; and $R^7$ and $R^8$ each represents a hydrogen atom or one of $R^7$ and $R^8$ represents a hydrogen atom and the other represents a substituted or unsubstituted alkylsulfonyl group, a substituted or unsubstituted arylsulfonyl group, or a substituted or unsubstituted acyl group, with the proviso that B, $R^8$ and the nitrogen atom to which B and $R^8$ are bonded may form the partial structure —N=C< of hydrazone.

In formula (III), the aliphatic group represented by A is preferably a $C_{1-30}$, and particularly preferably $C_{1-20}$ straight chain, branched, or cyclic alkyl group (the representation $C_{1-30}$ indicates that the group contains from 1 to 30 carbon atoms, etc.). The branched alkyl group may be cyclized so that a saturated heterocyclic group containing one or more hetero atoms therein is formed. Also, the alkyl group may contain substituents such as an aryl group, an alkoxy group, a sulfoxy group, a sulfonamide group and carbonamide group.

Examples of such substituents include a t-butyl group, an n-octyl group, a t-octy group, a cyclohexyl group, a pyrrolidyl group, an imidazolyl group, a tetrahydrofuryl group and a morpholino group.

In formula (III), the aromatic group represented by A is a monocyclic or bicyclic aryl group or unsaturated heterocyclic group. The unsaturated heterocyclic group may be condensed with a monocyclic or bicyclic aryl group to form a heteroaryl group.

Examples of the aromatic group represented by A include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Particularly preferred among these groups is a group containing benzene rings.

The aryl or unsaturated heterocyclic group represented by A may have substituents. Typical examples of such substituents include straight chain, branched, or cyclic alkyl groups, preferably having from 1 to 20 carbon atoms, aralkyl groups (preferably monocyclic or bicyclic groups having from 1 to 3 carbon atoms in the alkyl portion), alkoxy groups preferably having from 1 to 20 carbon atoms, substituted amino groups (preferably substituted by an alkyl group having from 1 to 20 carbon atoms), acylamino groups preferably having from 2 to 30 carbon atoms, sulfonamide groups preferably having from 1 to 3 carbon atoms, and ureido groups preferably having from 1 to 30 carbon atoms.

The group represented by A in formula (III) may comprise ballast groups which are commonly used in an immobile photographic additive such as coupler. As such ballast groups there may be used relatively photographically inactive groups containing 8 or more carbon atoms and can be selected from the group consisting of an alkyl group, an alkoxy group, a phenyl group, a alkylphenyl group, a phenoxy group, and an alkylphenoxy group.

The group represented by A in formula (III) may comprise a group which promotes adsorption to the surface of silver halide particles. Examples of such an adsorbing group include thiourea groups, heterocyclic thioamide groups, mercapto heterocyclic groups and triazole groups as described in U.S. Pat. Nos. 4,385,108 and 4,459,347, Japanese Patent Application (OPI) Nos. 195233/84, 200231/84, 201045/84, 201046/84, 201047/84, 201048/84 and 201049/84, and Japanese Patent Application Nos. 36788/84, 11459/85 and 19739/85.

Specific examples of the group represented by B include formyl groups, acyl groups such as acetyl groups, propionyl groups, trifluoroacetyl groups, chloroacetyl groups, benzoyl groups, 4-chlorobenzoyl groups, pivaloyl groups, and methoxycarbonyl groups, alkylsulfonyl groups such as methanesulfonyl groups and 2-chloroethanesulfonyl groups, arylsulfonyl groups such as benzenesulfonyl groups, alkylsulfinyl groups such as methanesulfinyl groups, arylsulfinyl groups such as benzenesulfinyl groups, carbamoyl groups such as methylcarbamoyl groups and phenylcarbamoyl groups, sulfamoyl groups such as dimethylsulfamoyl groups, alkoxycarbonyl groups such as methoxycarbonyl groups and methoxyethoxycarbonyl groups, aryloxycarbonyl groups such as phenoxycarbonyl groups, sulfinamoyl groups such as methylsulfinamoyl groups, alkoxysulfonyl groups such as methoxysulfonyl groups and ethoxysulfonyl groups, thioacyl groups such as methylthiocarbonyl groups, thiocarbamoyl groups such as methylthiocarbamoyl groups, and heterocyclic groups such as a pyridine ring. Particularly preferred among these groups are formyl groups and acyl groups.

In the group represented by B in formula (III), $R^8$ may form a partial structure

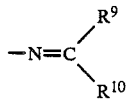

of hydrazine together with the nitrogen atom to which $R^8$ is bonded.

In the above formula, $R^9$ represents an alkyl group, an aryl group, or a heterocyclic group; and $R^{10}$ represents a hydrogen atom, an alkyl group, an aryl group, or a heterocyclic group.

$R^7$ and $R^8$ each represents a hydrogen atom, an alkylsulfonyl or arylsulfonyl group having 20 or less carbon atoms (preferably a phenylsulfonyl group or a phenylsulfonyl group which is substituted so that the sum of the Hammett substituent constants is −0.5 or more), or acyl groups having 20 or less carbon atoms (preferably a benzoyl group or a benzoyl group which is preferably substituted so that the sum of Hammett substituent constants is −0.5 or more, or straight chain, or branched, or cyclic substituted or unsubstituted aliphatic acyl group). Examples of the substituents include halogen atoms, ether groups, sulfonamide groups, carbonamide groups, hydroxyl groups, carboxyl groups, and sulfonic acid groups.

Particularly preferred among these groups represented by $R^7$ or $R^8$ is a hydrogen atom.

Specific examples of the hydrazine derivatives are shown below. However, the present invention is not to be construed as being limited by these examples.

I-1

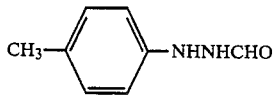

I-2

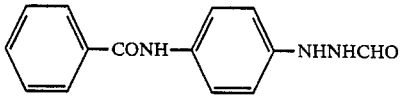

I-3

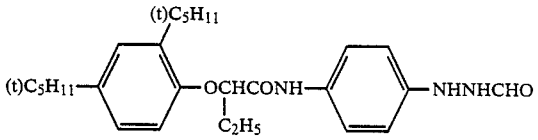

I-4

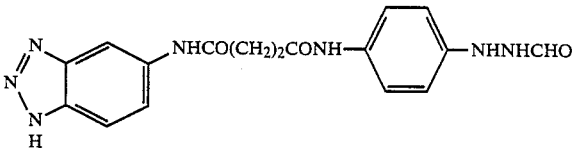

I-5

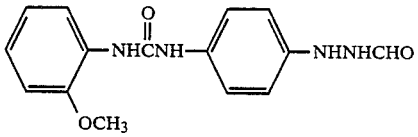

I-6

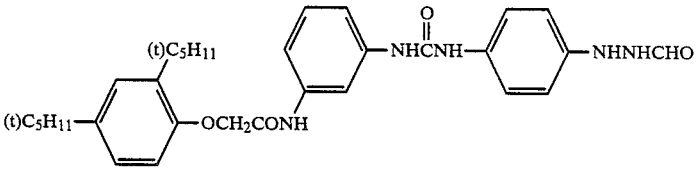

I-7

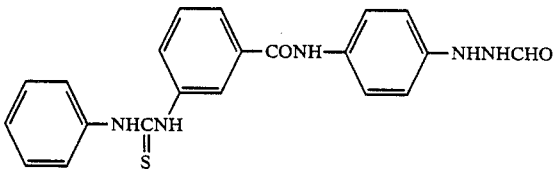

-continued
I-8
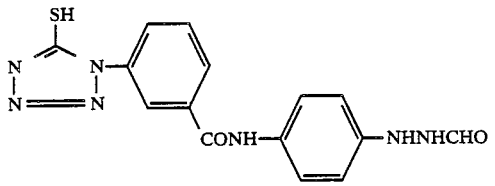
I-9
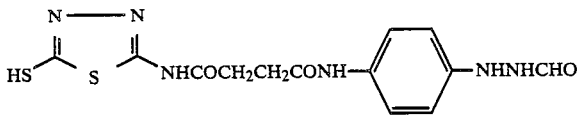
I-10
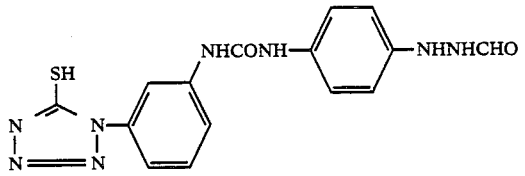
I-11
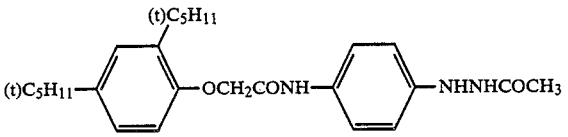
I-12
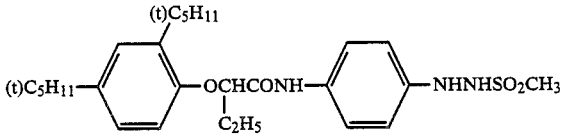
I-13
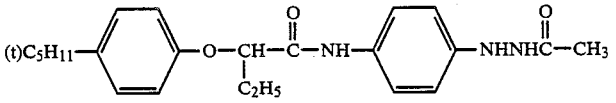
I-14
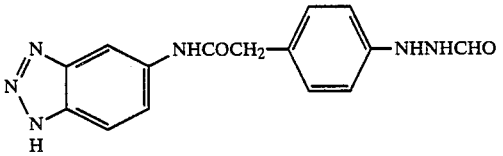
I-15
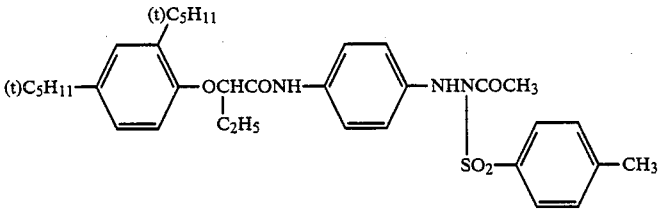
I-16
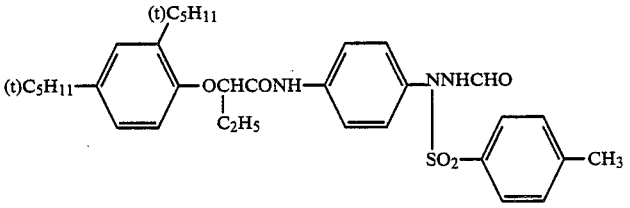
I-17
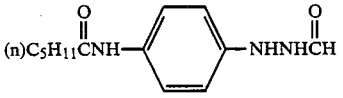

-continued

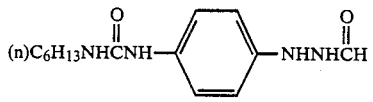

I-18

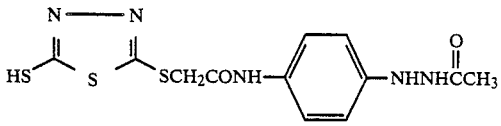

I-19

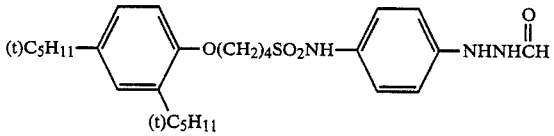

I-20

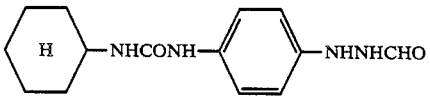

I-21

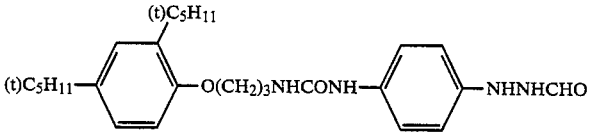

I-22

If the above-mentioned hydrazine derivative is used in the photographic material, it is preferably incorporated in the silver halide emulsion layer. However, it may be incorporated in other light-insensitive hydrophilic colloid layers such as protective layer, intermediate layer, filter layer, and antihalation layer. In particular, if the compound to be used is water-soluble, it may be added to the hydrophilic colloid solution in the form of an aqueous solution. On the contrary, if the compound is sparingly soluble in water, it may be added to the hydrophilic colloid solution in the form of a solution of an organic solvent miscible with water such as alcohols, esters and ketones. If the compound is used in the silver halide emulsion layer, its addition may be conducted at any time from the beginning of chemical ripening to coating and preferably from the completion of chemical ripening to coating. In particular, the compound is preferably added to a performed coating solution which has been prepared for coating.

The optimum content of the hydrazine derivative is preferably selected depending on the particle diameter, halogen composition, process and degree of chemical sensitization of the silver halide emulsion, relationship between the layer containing the hydrazine derivative and the silver halide emulsion layer, type of fog inhibitors used, etc. Test methods for selecting the content of the hydrazine derivative are well known to those skilled in the art. The amount of the hydrazine derivative to be used is preferably from $10^{-6}$ to $1\times10^{-1}$ mol, and particularly preferably from $10^{-5}$ to $4\times10^{-2}$ mol, per mol of silver halide.

Alternatively, the hydrazine derivative may be used in admixture with the developing solution. In this case, the added amount of the hydrazine derivative is from 5 mg to 5 g, and preferably from 10 mg to 1 g per liter of developing solution.

When Method 3 is used, a gradation ($\gamma$) of 10 or more can be obtained.

Method 4 can be accomplished with a rhodium content of from $10^{-7}$ to $10^{-3}$ mol/mol Ag.

The present image formation process is preferably accomplished by using a dihydroxybenzene developing agent as a developing agent, and a p-aminophenol developing agent and/or 1-phenyl-3-pyrazolidone developing agent as an auxiliary developing agent.

As such a dihydroxybenzene developing agent there may be used hydroquinone, chlorohydroquinone, bromohydroquinone, isopropylhydroquinone, methylhydroquinone, 2,3-dichlorohydroquinone, 2,3-dibromohydroquinone, or 2 5-dimethylhydroquinone. Particularly preferred among these compounds is hydroquinone.

Examples of a 1-phenyl-3-pyrazolidone developing agent or derivative thereof as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3pyrazolidone, 1-phenyl-5-methylpyrazolidone, 1-p-aminophenyl-4,4-dimethyl-3-pyrazolidone, and 1-p-tolyl-4,4-dimethyl-3-pyrazolidone.

As such a p-aminophenol auxiliary developing agent there may be used N-methyl-p-aminophenol, p-aminophenol, N-($\beta$-hydroxyethyl)-p-aminophenol, N-(4-hydroxyphenyl)glycine, 2-methyl-p-aminophenol, or p-benzylaminophenol. Particularly preferred among these compounds is N-methyl-p-aminophenol.

Such a dihydroxybenzene developing agent is preferably used in an amount of from 0.05 to 0.8 mol/liter. If a combination of a dihydroxybenzene developing agent and a 1-phenyl-3-pyrazolidone or p-aminophenol developing agent is used, the content of the former and the latter are preferably from 0.05 to 0.5 mol/liter, and 0.06 mol/liter or less, respectively.

Examples of sulfite preservatives that can be used in the present invention include sodium sulfite, potassium sulfite, lithium sulfite, sodium bisulfite, potassium metabisulfite, and formaldehyde sodium bisulfite. Such a sulfite may be generally used in an amount of 0.3 mol/-liter or more. However, if such a sulfite is used in an excess amount, it precipitates in the developing solution, contaminating the developing solution. Therefore, the upper limit of the amount of such a sulfite to be used is preferably 1.2 mol/liter.

The present developing solution may further contain a pH buffer such as boric acid, borax, tribasic sodium phosphate, and tribasic potassium phosphate. Furthermore, the present developing solution may contain a pH buffer as described in Japanese Patent Application (OPI) No. 93433/85. Moreover, the present developing solution may contain a development inhibitor such as potassium bromide and potassium iodide, an organic solvent such as ethylene glycol, diethylene glycol, triethylene glycol, dimethylformamide, methyl cellosolve, hexylene glycol, ethanol, and methanol, an indazole compound such as 5-nitroindazole, and a benzotriazole fog inhibitor or black pepper inhibitor such as sodium 2-mercaptobenzimidazole-5-sulfonate and 5-methylbenzo triazole. In particular, if a compound such as 5-nitroindazole is used, it is generally dissolved in a portion different from a portion which contains a dihydroxybenzene developing solution and a sulfite preservative, and both the portions are then mixed with each other. Water is added to the mixture. If the portion comprising 5-nitroindazole dissolved therein is rendered alkaline, it will be colored yellow. This is convenient for handling.

The present developing solution may optionally contain a toner, a surface active agent, water softener, and a hardener. The pH value of the present developing solution is preferably in the range of 9 or above, more preferably in the range of 9.5 to 12.3, most preferably in the range of from 10.5 to 12.3.

As a fixing solution for the present invention there may be used a composition which is commonly used. As a fixing agent there may be used an organic sulfur compound known as a fixing agent besides thiosulfate and thiocyanate. The present fixing solution may contain a water-soluble aluminum salt such as aluminum sulfate and alum as a hardener. The amount of such a water-soluble aluminum salt to be used is generally in the range of up to 3.0 g/liter, as calculated in terms of amount of Al. As an oxidizing agent there may be used an ethylenediaminetetraacetic acid Fe (III) complex salt.

The processing temperature is generally selected in the range of 18° C. to 50° C., but may be lower than 18° C. or higher than 50° C.

The present process is particularly suitable for a rapid processing using an automatic developing machine. As such an automatic developing machine there may be used a roller conveying type, a belt conveying type or any other suitable type. The processing time may be short. The total processing time may be less than 2 minutes, and is preferably 100 seconds or less. The present process is effective enough for a rapid developing process in which only 15 to 60 seconds is given to the developing step.

The halogen composition of the silver halide emulsion to be used is not specifically limited and may be silver chloride, silver chlorobromide, silver iodobromide, silver bromide, silver iodobromochloride, or the like. Particularly, the silver halide emulsion comprising silver chloride is preferably used for the improvement of unevenness in development using the compound of formula (I). The content of silver iodide is generally 5 mol % or less, and particularly preferably 3 mol % or less.

The particulate silver halide in the photographic emulsion to be used in the present invention may have a relatively wide distribution of particle size, but preferably has a narrow distribution of particle size. In particular, the size of 90% by weight or number of the total particles are preferably within ±40% of the average particle size. An emulsion having such a particle size distribution is generally referred to as a monodisperse emulsion.

The particulate silver halide to be used in the present invention is preferably in the form of finely divided particles having a particle size of 0.7 μm or less, and particularly 0.4 μm or less.

The particulate silver halide in the present photographic emulsion may be in the form of a regular crystal shape such as cubic, octahedral, or an irregular crystal shape such as spherical or plate-like, or may be a composite thereof.

The present particulate silver halide may comprise a multiphase construction in which an internal layer and a surface layer are the same or different from each other.

Two or more silver halide emulsions which have been separately prepared may be mixed with each other.

A cadmium salt, sulfite (e.g., sodium sulfite and potassium sulfite), lead salt, thallium salt, iridium salt or complex salt thereof, or rhodium salt or complex salt thereof may be present in the silver halide emulsion to be used in the present invention during the formation of the particulate silver halide or physical ripening.

In particular such a rhodium salt or complex salt thereof is preferably used because it further improves applicability to rapid processing. Typical examples of such a rhodium salt include rhodium chloride, rhodium trichloride, and rhodium ammonium chloride. Furthermore, complex salts of these rhodium salts can be used. The addition of such a rhodium salt can be conducted at any time before the completion of the first ripening during the formation of the emulsion, particularly preferably during the formation of particles. The added amount of the rhodium salt is particularly preferably in the range of from $1\times10^{-8}$ to $8\times10^{-5}$ mol per mol of silver.

In order to obtain photographical properties of a higher sensitivity and $\gamma$, the emulsion is preferably prepared in the presence of an iridium salt or its complex salt in an amount of $10^{-8}$ to $10^{-5}$ mol per mol of silver so that the resulting silver haloiodide has a silver iodide content of the particle surface which is greater than the average silver iodide content.

The above-described amount of the iridium salt is preferably added to the emulsion before the completion of physical ripening in the preparation of the silver halide emulsion, and particularly preferably during tee formation of the particles.

Examples of iridium salts which may be used in the present invention include water-soluble iridium salts or iridium complex salts such as iridium trichloride, iridium tetrachloride, potassium hexachloroiridiumate (III), potassium hexachloroiridiumate (IV), and ammonium hexachloroiridiumate (III).

As the present silver halide emulsion there may be used an emulsion which is not subjected to chemical ripening, i.e., so-called primitive emulsion. However, typically the silver halide emulsion is subjected to chemical ripening. Such chemical ripening can be accomplished by a process as described in H. Frieser, *Die Grundlagen der Photographischen Prozesse mit Silberhalogeniden,* published by Akademische Verlagsgesellschaft, 1968.

In particular, a sulfur sensitizing process using a compound containing active gelatin or sulfur, which is capable of reacting with silver, such as thiosulfate, thiourea, mercapto compound, and rhodanine, a reduction sensitizing process using a reducing substance such as stannous salt, amine, hydrazine derivative, formamidinesulfinic acid, and silane compound, and a noble metal sensitizing process using a noble metal compound such as gold compound and complex salt of the group VIII metal such as platinum, iridium, and palladium may be used singly or in combination.

As a suitable binder or protective colloid for the emulsion layer or intermediate layer in the present light-sensitive material, gelatin is advantageously used. Other hydrophilic colloids can be used.

Examples of such hydrophilic colloids include proteins such as gelatin derivatives, graft polymers of gelatin with other polymeric compounds, albumin, and casein, sugar derivatives such as cellulose derivatives, e.g., hydroxyethyl cellulose, carboxymethyl cellulose, and cellulose ester sulfate, sodium alginate, and starch derivatives, and various synthetic hydrophilic polymeric substances such as monopolymer and copolymers, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole.

Examples of such gelatin include lime-treated gelatin and acid-treated gelatin. An enzymatically treated gelatin such as that described in the *Bulletin of the Society of Scientific Photographic of Japan* (No. 16, page 30, 1966), or a product of hydrolysis or enzymatic decomposition of gelatin, may also be used.

The present light-sensitive material may comprise an acidic polymer in the form of a salt of a basic substance such as tertiary amine and alkali hydroxide.

A preferred acidic polymer preferably has acrylic acid as an acid group. The monomer composition which is copolymerized with acrylic acid is preferably alkyl acrylate or alkyl methacrylate.

A particularly preferred acidic polymer is in the form of a water-dispersed latex. Such an acidic polymer can be easily mixed with a water-soluble binder such as gelatin, polyacrylamide and polyvinyl alcohol without aggregation or sedimentation. The tertiary amine for the formation of acidic polymers is preferably used in such an amount as to neutralize 10 to 100 mol % of the acidic group in the acidic polymer, particularly 20 to 80 mol %.

The photographic emulsion to be used in the present invention may be spectrally sensitized by a methine dye or the like. Examples of such a dye which may be used in the present invention include a cyanine dye, a merocyanine dye, a composite cyanine dye, a composite merocyanine dye, a holopolar cyanine dye, a hemicyanine dye, a styryl dye and hemioxonol dye. Particularly useful among these dyes are cyanine dye, a merocyanine dye and a composite merocyanine dye. These dyes may be used in combination so that a supersensitization effect can be obtained.

The present photographic emulsion may contain a dye which provides no spectral sensitizing effect itself or a substance which does not substantially absorb any visible light but yet provides a supersensitizing effect together with such sensitizing dye. Examples of such a dye or substance which may be contained in the present photographic emulsion include aminostilbene compounds substituted by nitrogen-containing heterocyclic groups as described, for example, in U.S. Pat. Nos. 2,933,390 and 3,635,721, aromatic organic acidformaldehyde condensates as described, for example, in U.S. Pat. No. 3,743,510, cadmium salts, and azaindene compounds. Particularly useful are combinations as described in U.S. Pat. Nos. 3,615,613, 3,615,641, 3,617,295, and 3,635,721.

In order to inhibit fog during preparation, storage or photographic processing of the lightsensitive material or stabilize the photographic properties of the light-sensitive material, the photographic emulsion to be used in the present invention may contain various compounds. Examples of such compounds which may be contained in the present photographic emulsion include azoles such as benzothiazolium salts, nitroimidazoles, nitrobenzimidazoles, chlorobenzimidazoles, bromobenzimidazoles, mercaptothiazles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxazolinethione, azaindenes such as triazaindenes, tetraazaindenes (particularly 4-hydroxy-substituted (1,3,3a,7)tetraazaindenes), and pentaazaindenes, and many other compounds known as fog inhibitors or stabilizers such as benzenethiosulfonic acid, benzenesulfinic acid, and amide benzenesulfonate.

Particularly preferred among these compounds are benzotriazoles such as 5-methylbenzotriazole and nitroindazoles such as 5-nitroindazole. These compounds may optionally be contained in the processing solution.

The present photographic material may comprise an inorganic or organic hardener in the photographic emulsion layer or other hydrophilic colloid layer. Examples of such an inorganic or organic hardener include chromium salts such as chromium alum and chromium acetate, aldehydes such as formaldehyde, glyoxal, and glutaraldehyde, N-methylol compounds such as dimethylolurea, and methyloldimethylhydantoin, dioxane derivatives such as 2,3-dihydroxydioxane, active vinyl compounds such as 1,3,5-triacryloyl-hexahydro-s-triazine, and 1,3-vinylsulfonyl-2-propanol, active halogen compounds such as 2,4-dichloro-6-hydroxy-s-triazine, and mucohalogenic acids such as mucochloric acid, and mucophenoxychloric acid. These hardeners may be used singly or in combination.

The photographic emulsion layer or other hydrophilic colloid layers prepared in accordance with the present invention may contain various surface active agents in order to facilitate coating, prevent static electrification and adhesion, and improve emulsion dispersion, lubrication and photographic properties such as acceleration of development, high contrast and sensitization.

Examples of such surface active agents include nonionic surface active agents such as steroid saponin, alkylene oxide derivatives (e.g., polyethylene glycol, polyethylene glycol/polypropylene glycol condensate, polyethylene glycol alkyl ether or polyethylene glycol alkyl aryl ether, polyethylene glycol ester, polyethylene glycol sorbitan ester, polyalkylene glycol alkylamine or polyalkylene glycol alkylamide, and polyethylene oxide addition product of silicone), glycidol derivatives (e.g., alkenylsuccinate polyglyceride, and alkylphenol polyglyceride), aliphatic esters of polyvalent alcohols, and alkylesters of sugar; anionic surface active agents containing acidic groups such as a carboxy group, a sulfo group, a phospho group, a sulfuric ester group, and a phosphoric ester group such as alkylcarbonates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkyl polyoxyethylene alkylphenyl ethers, polyoxyethylene alkylphosphoric esters; amphoteric surface active agents such as amino acids, aminoalkylsulfonic acids, amino alkylsulfuric or aminophosphoric esters, alkylbetaines, and aminoxides; and cationic surface active agents such as alkylamine salts, aliphatic or aromatic quaternary ammonium salts, heterocyclic quaternary ammonium salts (e.g., pyridinium and imidazolium), and phosphonium or sulfonium salts containing aliphatic or heterocyclic groups.

Surface active agents which are particularly preferably used in the present invention include polyalkylene oxides having a molecular weight of 600 or more as described in Japanese Patent Publication No. 9412/83.

For the purpose of improvement in dimensional stability or like purposes, the photographic material to be used in the present invention may contain a dispersion of a water-insoluble or sparingly soluble synthetic polymer in the photographic emulsion layer or other hydrophilic colloid layer. For example, alkyl (meth)acrylate, alkoxyalkyl (meth)acrylate, glycidyl (meth)acrylate, (meth)acrylamide, vinylester (e.g., vinyl acetate), acrylonitrile, olefin, and styrene can be used singly or in combination. Alternatively, these compounds can be used in combination with acrylic acid, methacrylic acid, $\alpha,\beta$-unsaturated dicarboxylic acid, hydroxyalkyl (meth)acrylate, sulfoalkyl (meth)acrylate, styrenesulfonic acid, or the like. Such a combination can be used as a monomer component.

The present invention is further illustrated in the following examples, but the present invention is not to be construed as being limited thereto.

EXAMPLE 1

Anhydro-5,5-dichloro-9-ethyl-3,3-bis(3-sulfopropyl-)oxacarbocyanine hydroxide sodium salt (sensitizing dye) in an amount of 230 mg/1 mol of silver, 1-formyl{2,4-[2-(2,4-di-t-benzylphenoxy)butyramido]-phenyl}hydrazide as a hydrazine derivative in an amount of 1.0 g/1 mol of silver, and polyethylene glycol having a molecular weight of 1,000 in an amount of 300 mg/1 mol of silver were added to an emulsion of cubic silver iodobromide having a particle size of 0.3 $\mu$m and containing 2.5 mol % of iodide. Furthermore, a dispersion of 5-methylbenzotriazole, 4-hydroxy-6-methyl-1,3,3a,7-tetraazaindene, and polyethylacrylate and 2-hydroxy-1,3,5-triazine sodium salt were added to the admixture.

The coating solution thus prepared was coated on a polyethylene terephthalate film support so that the coated amount of silver and gelatin were 4.0 g/m$^2$ and 2.5 g/m$^2$, respectively. The coating solution was further coated as a protective layer on the surface of the film thus formed so that the coated amount of gelatin was 1 g/m$^2$.

These films thus prepared were exposed to light through a sensitometry exposure wedge by means of a 150-line magenta contact screen. These films thus exposed were then developed with developing solutions having the following compositions at a temperature of 34° C. for 30 seconds. These films were then subjected to fixation, rinsing, and drying. (This processing was carried out by means of Fuji Photo Film Co.'s automatic developing machine FG 660F.)

TABLE 1

| | Developing Solution A | Developing Solution B | Developing Solution C | Developing Solution D |
|---|---|---|---|---|
| Tetrasodium ethylenediaminetetraacetate | 1.0 g | " | " | " |
| Sodium hydroxide | 9.0 g | " | " | " |
| Tribasic potassium phosphate | 74.0 g | " | " | " |
| Potassium sulfite | 90.0 g | " | " | " |
| 5-Methylbenzotriazole | 0.5 g | " | " | " |
| Sodium bromide | 3.0 g | " | " | " |
| p-Aminophenol $\frac{1}{2}H_2SO_4$ | 1.0 g | " | " | " |
| Hydroquinone | 35.0 g | " | " | " |
| n-Butyldiethanolamine | 12.0 g | " | " | " |
| Sodium p-toluenesulfonate | 14.0 g | " | " | " |
| Compound I-24 (present invention) | — | 129 mg (0.5 mM) | — | — |
| Compound I-14 (present invention) | — | — | 111 mg (0.5 mM) | — |
| 1-Phenyl-5-mercaptotetrazole (comparative compound) | — | — | — | 89 mg (0.5 mM) |
| Water to make | 1 l | " | " | 89 mg (0.5 mM) |
| pH | 11.7 | 11.7 | 11.7 | 11.7 |

The results are shown in Table 2. Table 2 shows the reciprocal of the exposure required to obtain density of 1.5 when the light-sensitive material is processed with Developing Solutions A to B. (The values shown are values relative to that of Developing Solution A as 100.) $\overline{G}$ represents tan $\theta$ of the straight line between a density of 0.3 and a density of 3.0 on the characteristic curve. The dot quality is represented by the 5-step evaluation in which "5" is the most excellent and "1" is the worst. A dot quality "4" or higher is quite practicable in dot plates for use in plate making. The dot quality "3" is the lowest practicable level. The dot quality "2" or lower is unpractical.

The evenness in development is represented by the 5-step evaluation in which "5" is the most excellent and "1" is the worst. Step "5" indicates that there is no unevenness in development. Step "1" indicates that there is unevenness in development on the entire surface of the film. Step "4" indicates that there is unevenness in development on an extremely small portion of the film. Step "4" is a practicable level. Step "3" or lower is unpractical.

TABLE 2

| Experiment No. | Developing Solution Used | Sensitivity | Dot Quality | Evenness in Development | $\overline{G}$ |
|---|---|---|---|---|---|
| 1 | Developing Solution A (comparison) | 100 | 5 | 2 | 20 |
| 2 | Developing Solution B (present invention) | 100 | 5 | 5 | 20 |
| 3 | Developing Solution C (present invention) | 100 | 5 | 5 | 20 |
| 4 | Developing Solution D (comparison) | 70 | 3 | 5 | 12 |

Table 2 shows that the present Developing Solutions B and C provide excellent evenness in development. For comparison, Developing Solution A, which does not contain a compound of formula (I), results in much unevenness in development and is thus impracticable. For further comparison, Developing Solution D, which contains a compound of formula (I) wherein $R^1$ and $R^2$ both represent a hydrogen atom, provides an excellent evenness in development but gives a low sensitivity and a poor dot quality.

EXAMPLE 2

Solution I: Water 1,000 ml, gelatin 20 g, pH =4.0
Solution II: $AgNO_3$ 200 g, water 600 ml
Solution III: KBr 4.2 g, NaCl 75 g, $PhCl_3$ 20 mg, water 600 ml Solution II and Solution III were added to Solution I (a gelatin aqueous solution) which had been kept at a temperature of 45° C. at the same time at a constant rate in 30 minutes. Soluble salts were removed from the emulsion thus formed by an ordinary method which is well known in the art. Gelatin was added to the emulsion. The admixture was not chemically ripened. 2-Methyl-4-hydroxy-1,3,3a,7-tetraazaindene was added to the emulsion as a stabilizer. The average size of the particles in the emulsion was 0.28 μm. The yield of the emulsion was 1 kg. The gelatin content of the emulsion was 70 g. 2-Hydroxy-4,6-dichloro-1,3,5-triazine sodium salt was added to the emulsion as a hardener. The emulsion thus prepared was then coated on a polyethylene terephthalate film so that the coated amount of silver was 4.5 g/m². The emulsion was further coated as a protective layer on the surface of the film thus formed so that the coated amount of gelatin was 1 g/m².

These films thus prepared were brought into close contact with a manuscript of dot film and then exposed to light by means of Dai Nippon Screen Co.'s printer Type P-607. These films were developed with developing solutions having the following compositions at a temperature of 34° C. for 30 seconds. These films were then subjected to fixation, rinsing, and drying. This processing was carried out by means of Fuji Photo Film Co.'s automatic developing machine FG 660F.

TABLE 3

| | Developing Solution E | Developing Solution F | Developing Solution G | Developing Solution H |
|---|---|---|---|---|
| Tetrasodium ethylenediaminetetraacetate | 1.0 g | " | " | " |
| Sodium hydroxide | 9.0 g | " | " | " |
| Tribasic potassium phosphate | 74.0 g | " | " | " |
| Sodium sulfite | 75.0 g | " | " | " |
| 5-Methylbenzotriazole | 0.5 g | " | " | " |
| Sodium bromide | 3.0 g | " | " | " |
| 4-Methyl-4-hydroxymethyl-1-phenyl-3-pyrazolidone | 0.2 g | " | " | " |
| Hydroquinone | 35.0 g | " | " | " |
| n-Butyldiethanolamine | 12.0 g | " | " | " |
| Sodium p-toluenesulfonate | 14.0 g | " | " | " |
| Compound I-24 (present invention) | — | 129 mg (0.5 mM) | — | — |
| Compound I-14 (present invention) | — | — | 111 mg (0.5 mM) | — |
| 1-Phenyl-5-mercaptotetrazole (comparative compound) | — | — | — | 89 mg (0.5 mM) |
| Water to make | 1 l | 1 l | 1 l | 1 l |
| pH | 11.7 | 11.7 | 11.7 | 11.7 |

The results are shown in Table 4. Table 4 shows the reciprocal of the exposure required to obtain a density of 15 when the light-sensitive material was processed with Developing Solution E. (The values shown are values relative to that of Developing Solution E as 100.) $\overline{G}$, the dot quality, and evenness in development are as defined in Example 1.

TABLE 4

| Experiment No. | Developing Solution Used | Sensitivity | Dot Quality | Evenness in Development | $\overline{G}$ |
|---|---|---|---|---|---|
| 5 | Developing Solution E (comparison) | 100 | 5 | 2 | 7 |
| 6 | Developing Solution F (present invention) | 100 | 5 | 5 | 7 |
| 7 | Developing Solution G (present invention) | 100 | 5 | 5 | 7 |
| 8 | Developing Solution H | 80 | 3 | 5 | 4.5 |

TABLE 4-continued

| Experiment No. | Developing Solution Used | Sensitivity | Dot Quality | Evenness in Development | $\bar{G}$ |
|---|---|---|---|---|---|
| | (comparison) | | | | |

Table 4 shows that the present Developing Solutions F and G provide excellent evenness in development. For comparison, Developing Solution E, which does not contain a compound of formula (I), gives much unevenness in development and is thus impracticable. For further comparison, Developing Solution H, which contains a compound of formula (I) wherein $R^1$ and $R^2$ both represent a hydrogen atom, provides an excellent evenness in development but gives a low sensitivity and a poor dot quality.

EXAMPLE 3

An aqueous solution of silver nitrate and an aqueous solution of potassium bromide and potassium iodide were mixed with each other in the presence of ammonia by a double jet process while the pAg value thereof was maintained at 7.9 to prepare a monodisperse emulsion of cubic silver iodobromide particles having an average particle size of 0.2 μm (silver iodide: 2 mol %, silver bromide: 98 mol %) (Emulsion A). On the other hand, an aqueous solution of silver nitrate and an aqueous solution of potassium bromide were mixed with each other in the presence of ammonia by a double jet process while the pAg thereof was maintained at 7.9 to prepare a monodisperse emulsion of cubic silver bromide particles having an average particle size of 0.35 μm (Emulsion B). Emulsion A was sulfur-sensitized with sodium thiosulfate.

5,5'-Dichloro-3,3'-di(3-sulfopropyl)-9-ethyloxacarbocyanine sodium salt as a sensitizing dye was added to both Emulsions A and B in amounts of $6\times10^{-4}$ mol and $4.5\times10^{-4}$ mol per mol of silver, respectively, so that the two emulsions were spectrally sensitized.

Furthermore, 4-hydroxy-6-methyl-1,3,3a,7-tetraazaindene was added to the emulsions as a stabilizer.

Emulsions A and B thus prepared were mixed in a mixing ratio of 6/4 as calculated in terms of weight of silver halide. A compound represented by the formula shown below was added to the mixture in an amount of 0.40 g/m².

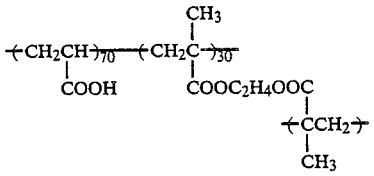

Furthermore, a hydrazine derivative represented by the formula shown below was added to the mixture in an amount of $4\times10^{-3}$ mol per mol of silver.

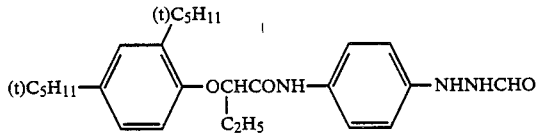

An alkylbenznnesulfonate was added to the mixture as a surface active agent so that the pH value of the emulsion was adjusted to 5.8. Thsse emulsions thus prepared were coated on a 100-μm thick polyethylene terephthalate support so that the coated amount of silver was 3.0 g/m². These emulsions were further coated on the surface of the film thus formed as a protective layer so that the coated amount of gelatin was 1 g/m². Thus, Film No. 1 (16) was prepared.

After being stored at a temperature of 40° C. and a relative humidity of 65% RH for 16 hours, these specimens were exposed to light from a 3,200° K. tungsten lamp through a sensitometry optical wedge by means of a 150-line magenta contact screen for 5 seconds. These specimens were then developed with developing solutions having the following compositions at a temperature of 38° C. for 20 seconds. The development processing was carried out by means of Fuji Photo Film Co.'s automatic developing machine FG 660F.

The samples thus obtained were measured by a Macbeth densitometer for density to evaluate the photographic properties thereof.

On the other hand, an aqueous solution of silver nitrate and an aqueous solution of sodium chloride containing ammonium rhodium (III) acid hexachloride in an amount of $5\times10^{-6}$ mol per mol of silver were mixed with each other at a temperature of 40° C. by a double jet process while the pH thereof was maintained at 2.3 so that a monodisperse emulsion of silver chloride particles having an average particle size of 0.2 μm was prepared.

Soluble salts were removed from the emulsion thus prepared by a flocculation process well known in the art. 4-Hydroxy-6-methyl-1,3,3a,7-tetraazaindene and 1-phenyl-5-mercaptotetrazole as stabilizers were added to the emulsion. As a result, the contents of silver and gelatin in the emulsion were 55 g and 105 g per 1 kg, respectively.

A compound represented by the formula shown below was added to the emulsion in an amount of 70 mg/m².

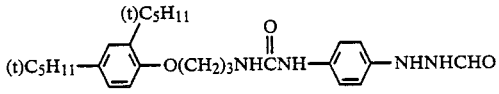

Furthermore, 2,4-dichloro-6-hydroxy-1,3,5-triazine sodium salt as a hardener was added to the emulsion. The emulsion thus prepared was then coated on a polyethylene terephthalate transparent support so that the coated amount of silver was 3.5 g per 1 m². Gelatin was coated on the surface of the film thus formed as a protective layer to prepare Film No. 2.

Film No. 2 was then exposed to light through an optical wedge by means of Dai Nippon Screen Co.'s P617 Type DQ printer (light source: 100 v, 1 kw quartz halogen lamp). The film thus exposed was developed with Developing Solutions A, B, C and D shown in Table 1 at a temperature of 38° C for 20 seconds. The film thus developed was then subjected to fixation, rinsing, and drying.

The results are shown in Table 5. The sensitivity of Film No. 1 in Experiment Nos. 9 to 12 are represented by the reciprocal of the exposure required to obtain a density of 1.5 when the light-sensitive material is developed with Developing Solution A. The values shown are values relative to that of Developing Solution A as 100. The sensitivity of Film No. 2 in Experiment Nos. 13 to 16 are represented in the same manner as described above. G, dot quality, and evenness in development are as defined in Example 1.

TABLE 5

| Experiment No. | Film Used | Developing Solution Used | Sensitivity | Dot Quality | Evenness in Development | $\bar{G}$ |
|---|---|---|---|---|---|---|
| 9 | No. 1 | Developing Solution A (comparison) | 100 | 5 | 2 | 20 |
| 10 | No. 1 | Developing Solution B (present invention) | 100 | 5 | 5 | 20 |
| 11 | No. 1 | Developing Solution C (present invention) | 100 | 5 | 5 | 20 |
| 12 | No. 1 | Developing Solution D (comparison) | 70 | 3 | 5 | 12 |
| 13 | No. 2 | Developing Solution A (comparison) | 100 | — | 2 | 25 |
| 14 | No. 2 | Developing Solution B (present invention) | 100 | — | 5 | 25 |
| 15 | No. 2 | Developing Solution C (present invention) | 100 | — | 5 | 25 |
| 16 | No. 2 | Developing Solution D (comparison) | 80 | — | 5 | 15 |

Table 5 shows that the present Developing Solutions B and C provide excellent evenness in development. For comparison, Developing Solution A, which does not contain a compound represented by formula (I), gives much unevenness in development and thus is impracticable. For further comparison, Developing Solution D, which contains a compound of formula (I) wherein $R^1$ and $R^2$ both represent a hydrogen atom, provides an excellent evenness in development, but gives a low sensitivity and a poor dot quality.

While the invention has been described in detail and with reference to specific embodiments thereof, it will be apparent to one skilled in the art that various changes and modifications can be made therein without departing from the spirit and scope thereof.

What is claimed is:

1. A process for the formation of a high contrast negative image which comprises processing a silver halide photographic material with a developing solution having a pH value of 9 or more, wherein said developing solution contains a dihydroxybenzene developing agent, a 1-phenyl-3-pyrazolidone auxiliary developing agent and/or p-amino-phenol auxiliary developing agent, 0.3 mol/liter or more of a sulfite, and a compound represented by formula (I).

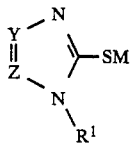

(I)

wherein Y and Z each represents N or $CR^2$ wherein $R^2$ represents a substituted or unsubstittued alkyl or aryl group; $R^1$ represents an alkyl, aryl or heteroccylic groups consisting of $—SO_3M$, —COMM, —OH, $—NHSO_2R^3$, $—SO_2NR^3R^4$ and $—NR^5CONR^3R^4$ or a group formed by bonding alkyl, aryl or heterocyclic groups via a linkage group and substituted by at least one group selected from the group consisting of $—SO_3M$, —COOM, —OH, $—NHSO_2R_3$, $—SO_2NR_3R_4$ and $—NR^5CONR^3R^4$; $R^3$, $R^4$, and $R^5$ each represents a hydrogen atom or a lower alkyl group containing from 1 to 4 carbon atoms; and M represents a hydrogen atom, alkali metal atom, quaternary ammonium, or quaternary phosphonium.

2. A process for the formation of a high contrast negative image as in claim 1, wherein said alkyl group represented by $R^1$ is a straight chain or branched alkyl group containing from 1 to 20 carbon atoms or a cycloalkyl group containing from 1 to 20 carbon atoms.

3. A process for the formation of a high contrast negative image as in claim 1, wherein said aryl group represented by $R^1$ is an aryl group containing from 6 to 20 carbon atoms.

4. A process for the formation of a high contrast negative image as in claim 1, wherein said heterocyclic group represented by $R^1$ is a 5-, 6- or 7-membered heterocyclic group containing one or more nitrogen, oxygen, or sulfur atoms or a heterocyclic group which forms a condensed ring.

5. A process for the formation of a high contrast negative image as in claim 1, wherein the linkage group contained-d in R1 is selected from

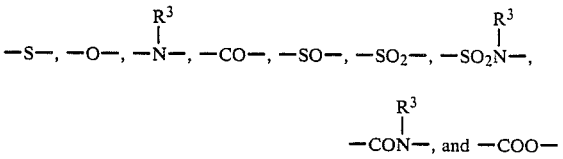

wherein $R^3$ has the same definition as in formula (I).

6. A process for the formation of a high contrast negative image as in claim 1, wherein said compound of formula (I) is represented by formula (II)

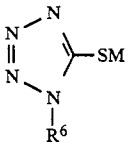

(II)

wherein $R^6$ represents a phenyl group substituted by at least one selected from the group consisting of —COOM, $—SO_3M$, —OH, $—NHSO_2R^3$, $—SO_2NR^3R^4$ or $—NR^5CONR^3R^4$, and $R^3$, $R^4$, $R^5$ and M have the same definition as in formula (I), said phenyl group may be further substituted.

7. A process for the formation of a high contrast negative image as in claim 6, wherein $R^6$ of formula (II)

is a phenyl group substituted by —COOM or —$SO_3M$ wherein M has the same definition as in formula (I).

8. A process for the formation of a high contrast negative image as in claim 1, wherein said method comprises rendering the particle size distribution of a silver halide emulsion monodisperse.

9. A process for the formation of a high contrast negative image as in claim 1, wherein said method comprises using silver chloride or silver chlorobromide as a halogen composition for the silver halide emulsion.

10. A process for the formation of a high contrast negative image as in claim 1, wherein said method comprises development in the presence of a hydrazine compound or a tetrazolium salt compound.

11. A process for the formation of a high contrast negative image as in claim 1, wherein said method comprises using a silver halide emulsion containing a compound of the group VIII metal.

12. A process for the formation of a high contrast negative image as in claim 11, wherein the compound of the group VIII metal is a rhodium salt.

13. A process for the formation of a high contrast negative image as in claim 1, wherein said high contrast means having a gradation ($\gamma$) of 4 or more.

14. A process for the formation of a high contrast negative image as in claim 1, wherein said silver halide is silver chloride.

15. A process for the formation of a high contrast negative image as in claim 1, wherein $R_1$ represents an alkyl, aryl or heterocyclic group which is substituted by at least one group selected from the group consisting of —$SO_3M$, —COOM, —OH, $NHSO_2R^3$, —$SO_2NR^3R^4$ and —$NR^5CONR^3R^4$ or a group formed by bonding alkyl or aryl groups via a linkage group and substituted by at least one group selected from the group consisting of —$SO_3M$, —COOM, OH, —$NHSO_2R^3$, —SO2$NR^3R^4$ and —$NR^5CONR^3R^4$; $R^3$, $R^4$ and $R^5$ each represents a hydrogen atom or a lower alkyl group containing from 1 to 4 carbon atoms; and M represents a hydrogen atom. alkali metal atom, quaternary ammonium, or quaternary phosphonium.

* * * * *